US006364973B1

(12) United States Patent
Golle et al.

(10) Patent No.: US 6,364,973 B1
(45) Date of Patent: Apr. 2, 2002

(54) DEEP-DRAWN PARTS MADE OF SPRING SHEET STEEL WHICH ARE ESPECIALLY USED AS A LIGHTWEIGHT STRUCTURAL MEMBER OR VEHICLE BODY PART, AND A METHOD FOR THE PRODUCTION THEREOF

(75) Inventors: Roland Golle, Pechbrunn; Hartmut Hoffmann, Bad Wimpfen; Volker Thoms, Calw, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/647,608

(22) PCT Filed: Mar. 11, 1999

(86) PCT No.: PCT/EP99/01578

§ 371 Date: Mar. 27, 2001

§ 102(e) Date: Mar. 27, 2001

(87) PCT Pub. No.: WO99/51376

PCT Pub. Date: Oct. 14, 1999

(30) Foreign Application Priority Data

Apr. 3, 1998 (DE) ..... 198 15 022

(51) Int. Cl.[7] ..... C22C 38/07; C21D 7/00; C21D 8/02

(52) U.S. Cl. ..... 148/652; 148/320; 148/650; 148/653; 148/654

(58) Field of Search ..... 148/320, 650, 148/651, 653, 652, 654, 601

(56) References Cited

U.S. PATENT DOCUMENTS

| | | | | |
|---|---|---|---|---|
| 4,033,789 A | | 7/1977 | Hamburg et al. | 148/12 F |
| 4,609,410 A | | 9/1986 | Hu | 148/142 |
| 4,619,714 A | * | 10/1986 | Thomas et al. | 148/320 |
| 5,213,634 A | * | 5/1993 | DeArdo et al. | 148/334 |

FOREIGN PATENT DOCUMENTS

| | | |
|---|---|---|
| FR | 2 748 033 | 10/1997 |

* cited by examiner

*Primary Examiner*—Deborah Yee
(74) *Attorney, Agent, or Firm*—Crowell & Moring, LLP

(57) ABSTRACT

The invention relates to drawn pieces made of steel plate, particularly for motor vehicles bodies, and to a process for manufacturing such drawn pieces. In order to be able to manufacture drawn pieces with a high piece strength but of a low weight and with a low susceptibility to denting in a simple manner, according to the invention, a spring steel plate which is already hardened in the initial state, particularly bainitized—for example, CK60 or C63 or 67SiCr5—is used during the drawing of the vehicle body parts. The yield point of the heat-treated plate bar material is approximately in the range of from 800 to 1,800 N/mm$^2$; the tensile strength is above that. Because of these strength values, plate bars of a plate thickness of approximately 0.3 mm to 0.6 mm can be used, whereby approximately 20 to 60% of the previous piece weight can be saved. The drawn piece according to the invention is therefore a definite lightweight part. In addition to being bainitized, the spring steel plate can be mechanically hardened, for example, by cold rolling or by a heat treatment.

16 Claims, No Drawings

DEEP-DRAWN PARTS MADE OF SPRING SHEET STEEL WHICH ARE ESPECIALLY USED AS A LIGHTWEIGHT STRUCTURAL MEMBER OR VEHICLE BODY PART, AND A METHOD FOR THE PRODUCTION THEREOF

The invention relates to drawn parts made of steel plate, particularly for motor vehicle bodies, such as vehicle body outer skin parts and load-bearing structural parts, but also to comparable lightweight construction parts of different applications as well as to a corresponding manufacturing process.

Preferably high-quality drawn steel types are used nowadays in vehicle body construction for the exterior covering parts. Since, because of the low yielding point of the material, these steel types can be deformed very easily, minor damages during the manufacturing, but particularly during the use of the finished vehicle will necessarily lead to permanent deformations. Minor bumps, for example, when parking on parking lots, the impact of rocks, hail, or the like, result in dents which can be removed only at relatively high expenditures.

It is known (*Krafthand* Journal, Volume 4, Feb. 15, 1986, Pages 151 to 159) to use high-strength steel types in vehicle body construction for exterior covering parts of vehicle bodies which, although they require higher expenditures for repair work, are nevertheless less susceptible to damage. However, no detailed information is supplied there with respect to the recommended higher-strength steel types. Neither concrete materials, nor characteristic values, nor a pretreatment of the materials are mentioned. The different characteristic processing values to which reference is made there with respect to "standard sheet metal" in comparison to "higher-strength sheet metal" indicate, because of the relative small difference, that the "higher-strength sheet metals" are those which have an inherently higher material strength in the unhardened state.

German Patent Document DE 195 29 881 C1 suggests the deep drawing of vehicle body parts made of a hardenable spring steel—preferably in the hot state—and bringing the workpiece to spring steel hardness only in the finished drawn condition. This method of operation requires high-expenditure heatable deep-drawing tools and a quenching system integrated in the pressing facility, which is cumbersome and results in expectations of a high fault rate in the series operation with such a heterogeneous manufacturing using a hot deforming and a heat treatment.

In a contribution from the German journal *Bleche Rohre Profile,* 40 (1993), Page 906 and on, with the title "New Developments in the Manufacturing of Motor Vehicle Parts", the term "higher-strength steel types" is also used for vehicle body steel plates, which, however, are steel materials which are not heat-treated and which, because of their alloy composition, inherently, that is, in the unhardened state, of a higher material strength than conventional sheet metal steels. In this context, the following steel types are mentioned: Age-hardening steel, Ti- and Nb-micro-alloyed steel as well as martensitic and bainitic polyphase steel. It is explicitly mentioned there that generally the deformability decreases as the strength rises. Problems in this respect are discussed there in detail.

It is an object of the invention to be able to manufacture in a simple manner drawn pieces of the initially mentioned type which have a high strength.

According to the invention, this object is achieved by means of the characterizing features of Claim 1 (drawn piece) and by those of Claim 6 (process). Accordingly, for drawn pieces, particularly for vehicle body parts, a spring steel is used in the heat-treated, specifically bainitized state, and this spring steel is deep-drawn or stretch-formed. This can be achieved surprisingly well despite the hardened metal plate by means of a corresponding tool design, press design and process forces. However, for this purpose, significantly higher process forces are required than previously. All process parameters required for the deformation have to be newly determined empirically, which can, however, easily be achieved within the scope of normal optimizing tests and as a function of the respective component.

Because of the fact that, during the deforming process, the spring steel can be stressed without failing by a significantly higher hold-down force and deforming force—in comparison to conventional deep-drawn steel types—, surprising large deforming degrees or deep drawing can be achieved. Because of the characteristic mechanical values of the hard spring steel plate, which are usually poor for a suitability for deep drawing, specifically a low uniform elongation and elongation at rupture, a low consolidation index, a low vertical anisotropy, a high deformability could definitely not be expected. Because of the nevertheless possible, high degrees of deformation, not only less deep-drawn outer skin pieces can be deep-drawn without any problems, but also load-bearing structural parts for which greater degrees of deformation are required. In the case of the latter, it is useful to superimpose a fine structuring—honeycomb or waffle structure—at least in slightly curved areas of the drawn piece, so that a high stiffness can be achieved here.

As the strength increases, that is, as the elastic limit rises, hardened metal plates generally lose deforming capacity. The measurable mechanical characteristic values, such as the uniform elongation or the elongation at rupture usually diminish as the strength of the plate bar material increases. This also applies to the bainitized spring steel recommended according to the invention. However, surprisingly, this material has unusually high characteristic deforming values "vertical anisotropy" and "consolidation index", which are not customary for conventionally hardened spring steel. Because of the high characteristic deforming values of the bainitized spring steel recommended according to the invention, it is possible that very high process forces can be transmitted without cracks. The process forces occurring or to be used in this case may reach approximately ten to twenty times the process forces during the deep drawing of conventional deep-drawn steel. Because of these surprisingly high characteristic deforming values of the bainitized spring steel recommended according to the invention, the good deep-drawing results could be achieved in an interaction with the abnormal process forces.

In this context, it should be pointed out that the deep drawing or stretch forming of metal plate components makes significantly higher demands on the deformability of a material than other deforming processes, such as bending or punching. In the case of deformation-critical materials, the deep drawing or stretch forming is only slightly more difficult to control than the bending, because the drawing results in a surface enlargement with respect to the starting plate bar. Not every material which can easily be cold-bent is also easily suitable for use as a drawn material.

The heat treatment of the bainitizing of spring steel is known per se. In older German-language literature references, this type of heat treatment is also called isothermal hardening or austempering. It is also known that bainitized spring steel can be cold-deformed (compare, for example, a contribution from the technical journal *Draht,* 3

(1992), Pages 307 to 310). However, as far as the applicant knows, only bending or punching are known as deforming methods of such materials, but not deep drawing or stretch forming, for which a much higher degree of stretching and upsetting and mainly a multidimensional stretching and upsetting is demanded.

During the bainitizing, the steel has to be cooled from the austenization temperature and from the austenized condition very rapidly—approximately within one second—to a temperature which is clearly above the martensite starting temperature, thus, for example, to approximately 300 to 350° C., for which salt baths or lead baths can be used. The steel must then be maintained at this temperature for a certain time which depends on the alloying of the steel—for approximately 2 to 10 minutes—until the austenite is transformed completely into a bainitic structure. Only then can the steel cool to room temperature, which can take place by allowing it to stand or by blower cooling.

The yield point of the hardened bainitized spring steel is approximately in the range of from 800 to 1,800 N/mm$^2$, preferably 900 to 1,200 N/mm$^2$; the tensile strength is by approximately 100 to 200 N/mm$^2$ above it. Although—as mentioned above—, the deforming capacity of a material decreases with its increasing yield point, of the bainitized spring steels from the PT group known to the applicant, the spring steel with the name PT120 with a tensile strength of 1,200 N/mm$^2$ and a yield point of 1,000 N/mm$^2$ is particularly recommended because, according to the applicant's knowledge, it has a very good strength in this group combined with very good deforming characteristics. Spring steel may be used which is made of conventional carbon steel—, for example, of the DIN (standard) designations CK60 or C63—or of stainless alloyed spring steel—such as 67SiCr5—. The use of stainless steel plate is recommended in this case particularly because the expected durability of the less dent-susceptible motor vehicle body parts is higher than previously and because a rusting-through in the case of non-stainless steel types with a high durability and smaller wall thickness is possible earlier than previously.

The spring steel with the designation Ck60 (according to DIN) or 2 C 60 (according to Euronorm 83), which, for example, is recommended, has the following composition in weight percent:

| | |
|---|---|
| Carbon | 0.57–0.65%, |
| silicium | to 0.40%, |
| manganese | 0.60–0.90%, |
| phosphorus | max. 0.035%, |
| sulfur | max. 0.030% and the remainder of iron. |

Because of the high strength of the material, a metal plate which is clearly reduced in its thickness—approximately 0.3 mm to 0.5 mm—in comparison to previously customary metal plate thicknesses—0.8 mm—can be processed to form vehicle body parts. Simultaneously, the vehicle body parts according to the invention exhibit an improved denting behavior; that is, the tendency for a plastic deformation in the event of minor damage is clearly lower than previously. As a rule, minor indentations rebound elastically to their original shape. As the result of the smaller metal plate thickness, the vehicle body parts produced therefrom, while the denting behavior is improved and the overall strength is the same, can be designed to be approximately 20% to 60% lighter than previously.

Because of the high denting resistance of the drawn pieces according to the invention, these are of interest not only for outer skin parts. On the contrary, the present invention opens up new application possibilities under the aspect of a lightweight vehicle body construction. The previously thinnest vehicle body metal plates had a thickness of approximately 0.7 mm. As a result of the invention, metal plate thicknesses of approximately 0.3 mm definitely seem possible with respect to aspects of strength, particularly when a fine structuring is superimposed on less curved workpiece areas. Because of a metal plate thickness reduction by up to 0.5 mm or to approximately one third of the previous wall thickness which seems possible, considerable reductions of weight should be possible on the motor vehicle body structure which are at least equal to the use of light metals. If, in addition, a spring-hard stainless steel is used, the corrosion disadvantage of thin steel plates can also be compensated.

Summarizing, it should be noted that the invention relates to a drawn piece made of steel plate, particularly for motor vehicle bodies and to a process for the manufacturing of such drawn pieces. In order to be able to produce drawn pieces with a high piece strength but of a low weight and a low denting susceptibility in a simple manner, according to the invention, a spring steel plate which is already hardened in its initial condition, specifically bainitized—for example, CK60 or C63 or 67SiCr5—is used when drawing the vehicle body parts. As a result, plate bars with a plate thickness of approximately 0.3 mm to 0.5 mm can be used, which reduces the weight of the previous parts by approximately 20 to 60%. The drawn piece according to the invention is therefore a definite lightweight part. In addition to the bainitizing, the spring steel plate can be hardened mechanically, for example, by cold rolling to by a heat treatment. The yield point of the plate bar material is approximately in the range of from 800 to 1,800 N/mm$^2$ and the tensile strength is above it.

What is claimed is:

1. A drawn piece made of steel plate for motor vehicle bodies using a spring steel plate which is already hardened in its initial state by bainitizing, wherein the steel plate is made of steel with a composition, in weight %, of:

0.57–0.65% carbon,
up to 0.40% silicium,
0.60–0.90% manganese,
0.035%, maximum, phosphorus,
0.030%, maximum, sulphur, and
iron as the remainder.

2. The drawn piece according to claim 1, wherein the steel plate is made of steel with a yield point in an initial state or at undeformed points of from 800 to 1,800 N/mm$^2$.

3. The drawn piece according to claim 2, wherein the yield point is in a range of from 900 to 1,200 N/mm$^2$.

4. The drawn piece according to claim 1, wherein the spring steel plate has a plate thickness of from 0.3 to 0.6 mm.

5. The drawn piece according to claim 1, wherein a fine structuring in the form of a honeycomb or waffle structure is superimposed on less curved areas of the drawn piece.

6. A process for manufacturing drawn pieces for motor vehicle bodies during which a plate bar made of plate metal is placed in a drawing press and stretch formed, deep drawn, or both stretch formed and deep drawn by a closing deforming tool, comprising using a hardened, completely bainitized spring steel plate with a composition, in weight %, of:

0.57–0.65% carbon,
up to 0.40% silicium,
0.60–0.90% manganese,
0.035%, maximum, phosphorus, 0.030%, maximum, sulphur, and iron as the remainder, as a material for the plate bar.

7. The process according to claim 6, wherein, for bainitizing the spring steel plate, the steel plate is cooled, within approximately one second, from an austenizing temperature and from an austenized condition, using salt baths or lead baths, to a bainitizing temperature which is above the martensite starting temperature, maintained at the bainitizing temperature until austenite has completed a change into bainitic structure, and only then cooled to room temperature.

8. The process according to claim 7, wherein the steel plate is cooled to a bainitizing temperature of from 300 to 350° C.

9. The process according to claim 7, wherein the steel plate is held at the bainitizing temperature for 2 to 10 minutes and is completely bainitized.

10. The process according to claim 7, wherein cooling of the bainitized steel plate to room temperature takes place by allowing it to stand or by blower cooling.

11. The process according to claim 6, and further comprising hardening the spring steel plate by an additional heat treatment or mechanically before dividing said spring steel plate into plate bars.

12. The process according to claim 11, wherein the spring steel plate is hardened by cold rolling.

13. The process according to claim 6, wherein hardened stainless spring steel is used as the plate bar material for vehicle body parts endangered by corrosion.

14. The process according to claim 6, wherein spring steel with a yield point in the range of from 800 to 1,800 $N/mm^2$ is used as the plate bar material.

15. The process according to claim 14, wherein said yield point is in the range of from 900 to 1,200 $N/mm^2$.

16. The process according to claim 6, wherein the plate bar has a plate thickness of approximately 0.3 mm to 0.6 mm.

* * * * *